US006477351B1

(12) United States Patent
Thayer et al.

(10) Patent No.: US 6,477,351 B1
(45) Date of Patent: Nov. 5, 2002

(54) BLADE CLEANING SYSTEM EMPLOYING AN ELECTRODE ARRAY

(75) Inventors: Bruce E. Thayer, Webster, NY (US); Michael D. Thompson, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/723,094

(22) Filed: Nov. 27, 2000

(51) Int. Cl.[7] ..... G03G 21/00
(52) U.S. Cl. ..... 399/350; 399/358
(58) Field of Search ..... 399/350, 351, 399/358, 360

(56) References Cited

U.S. PATENT DOCUMENTS 4,423,950 A * 1/1984 Sagami ..... 399/358 X
4,647,179 A 3/1987 Schmidlin
4,875,081 A * 10/1989 Goffe et al. ..... 399/350 X
5,424,820 A * 6/1995 Bares et al. ..... 399/350
5,541,716 A 7/1996 Schmidlin
5,555,469 A * 9/1996 Ishikawa et al. ..... 399/359 X

* cited by examiner

*Primary Examiner*—William J. Royer
(74) *Attorney, Agent, or Firm*—Lloyd F. Bean, II

(57) ABSTRACT

An apparatus for removing residual particles from an imaging surface, including a cleaning blade having an edge adapted to remove the residual particles from the imaging surface; an electrode array, coacting with the cleaning blade, for removing residual toner particles in a direction of movement away from the edge of the cleaning blade; and a wave generator for generating a traveling wave pattern for moving residual particles in the direction of movement.

2 Claims, 4 Drawing Sheets

BLADE CLEANING SYSTEM EMPLOYING AN ELECTRODE ARRAY

BACKGROUND OF THE INVENTION

Cross reference is made to the following application filed concurrently herewith: U.S. Ser. No. 09/722,925 entitled "Toner Dispensing Apparatus Employing A Traveling Wave Transport Grid" by Bruce E. Thayer et al.

This invention relates generally to an electrostatographic printer and copier, and more particularly concerns a cleaning apparatus.

Blade cleaning of photoreceptors (i.e. imaging surfaces or photoconductors) is basically a simple and economical concept that has reliability concerns. Random failures justify the reluctance to include blade cleaners in higher volume machines without, or even with, some back-up cleaning element. Alternative cleaning devices, including magnetic, insulative and electrostatic brush assemblies are invariably installed as the primary cleaning element in higher volume machine applications. Use of devices exhibiting predictive or deterministic failure modes also facilitate identification and resolution of cleaning problems rising from other sources. Manifestations of deterministic cleaning failures include, but are not limited to, photoreceptor filming and cometing. (Cometing is where material, including toner particles, become impacted onto the photoreceptor and adhere with such force that they cannot be removed by the shearing or scraping action of the cleaning element.)

Toner cleaned by the tip of a cleaning blade often piles up on top of the blade and the supporting blade holder. This is often not a problem if the architectural location of the cleaner allows gravity to pull the toner pile down the blade surface. For architectural locations where gravity cannot cause the toner to flow easily across the blade surface toner can build up to the point where an active means is required to maintain toner flow away from the blade tip. These could include thumpers, stirrers, augers, paddlewheels or brushes. These devices can easily take up more space and cost more than the cleaning blade itself.

Therefore, there is a need to reduce cost of these devices and more importantly to reduce the space required to mount these devices.

SUMMARY OF THE INVENTION

Briefly stated, and in accordance with one aspect of the present invention, there is provided an apparatus for removing residual particles from an imaging surface, including a cleaning blade having an edge adapted to remove the residual particles from the imaging surface; an electrode array, coacting with said cleaning blade, for removing residual toner particles in a direction of movement away from the edge of said cleaning blade; and a wave generator for generating a traveling wave pattern for moving residual particles in said direction of movement.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
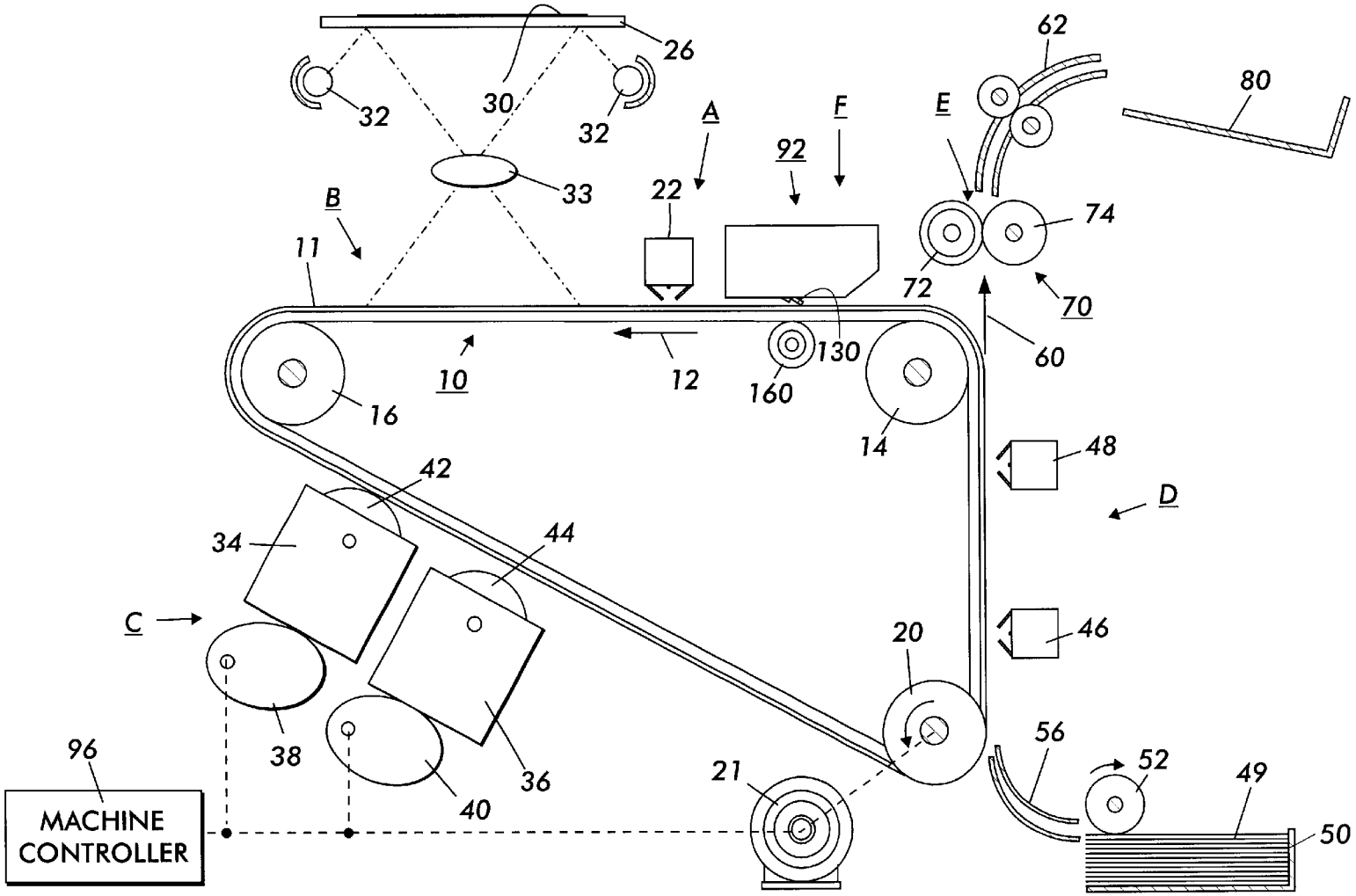
FIG. 1 is a schematic illustration of a printing apparatus incorporating the inventive features of the present invention.

For a general understanding of an electrophotographic printer or copier in which the present invention may be incorporated, reference is made to FIG. 1 which depicts schematically the various components thereof. Hereinafter, like reference numerals will be employed throughout to designate identical elements. Although the electrostatic brush cleaner with a secondary cleaner apparatus of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of belt 10 sequentially through the various processing stations disposed about the path of movement thereof. Belt 10 is entrained about a stripping roller 14, a tension roller 16, and a drive roller 20. Drive roller 20 is coupled to a motor 21 by suitable means such as a belt drive. Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

With continued reference to FIG. 1, initially a portion of belt 10 passes through charging station A. At charging station A, a corona device 22 charges a portion of the photoreceptor belt 10 to a relatively high, substantially uniform potential, either positive or negative. At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document.

Alternatively, a laser may be provided to imagewise discharge the photoreceptor belt in accordance with stored electronic information. Thereafter, belt 10 advances the electrostatic latent image to development station C. At development station C, one of at least two developer housings 34 and 36 is brought into contact with belt 10 for the purpose of developing the electrostatic latent image. Housings 34 and 36 may be moved into and out of developing position with corresponding cams 38 and 40, which are selectively driven by motor 21. Developer housings 34 and 36 support a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted. The photoreceptor belt 10 then advances the developed latent image to transfer station D.

At transfer station D, a sheet of support material such as paper copy sheets is advanced into contact with the developed latent images on belt 10. A corona generating device 46 charges the copy sheet to the proper potential so that it becomes tacked to the photoreceptor belt 10 and the toner powder image is attracted from the photoreceptor belt 10 to the sheet.

After transfer, a corona generator 48 charges the copy sheet to an opposite polarity to detach the copy sheet from belt 10, whereupon the sheet is stripped from belt 10 at stripping roller 14. Sheets of support material 49 are advanced to transfer station D from supply tray 50. Sheets are fed from tray 50 with sheet feeder 52, and advanced to transfer station D along conveyor 56. After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72.

In this manner, the toner powder image is permanently affixed to the sheet, and such sheets are directed via a chute 62 to an output tray 80 or finisher. Residual particles, remaining on the photoreceptor belt 10 after each copy is made, may be removed at cleaning station F. The cleaning apparatus of the present invention is represented by the reference numeral 92. (See FIGS. 2–4 for more detailed views of the present invention.) Removed residual particles may be stored for disposal. A machine controller 96 is preferably a known programmable controller or combination of controllers, which conventionally control all the machine steps and functions described above.

The controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein.

Reference is now made to FIGS. 2–5 where the showings are for the purpose of illustrating a preferred embodiment of the invention and not for limiting the same.

Figure 2:
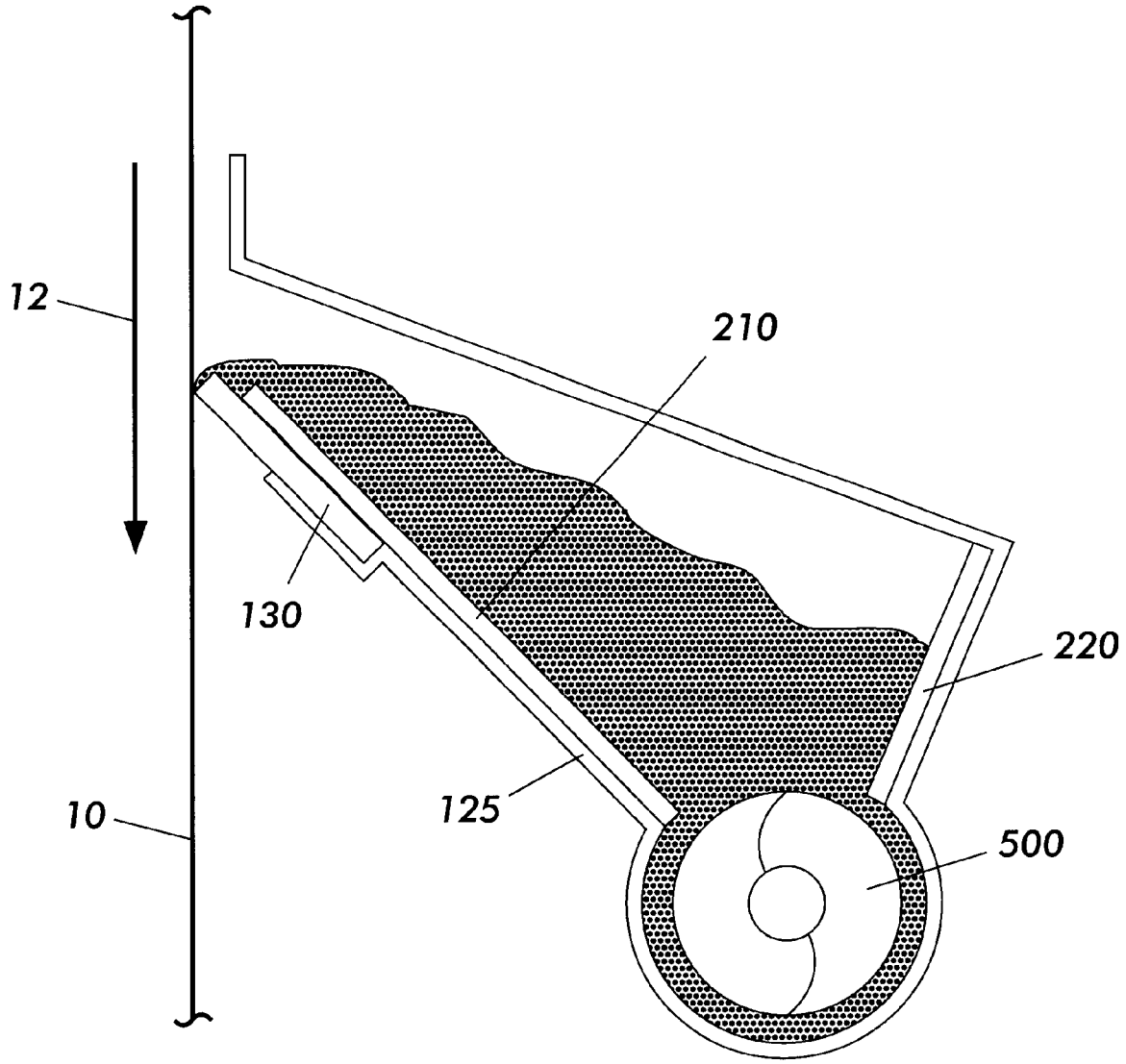
FIGS. 2 and 5 show a schematic elevational views of cleaning blade apparatuses of the present invention.

Referring to FIG. 2 which shows an example of how an elastomer cleaning blade 130 is mounted in a cleaner housing 125. The path of the toner cleaned from the photoreceptor belt 10 is down the length of the blade and into a transport auger 500. Because of the angular orientation of the cleaning blade 130 and the poor flow properties of some toners, this example represents a condition where toner flow through the cleaner housing could be of concern.

Figure 3:
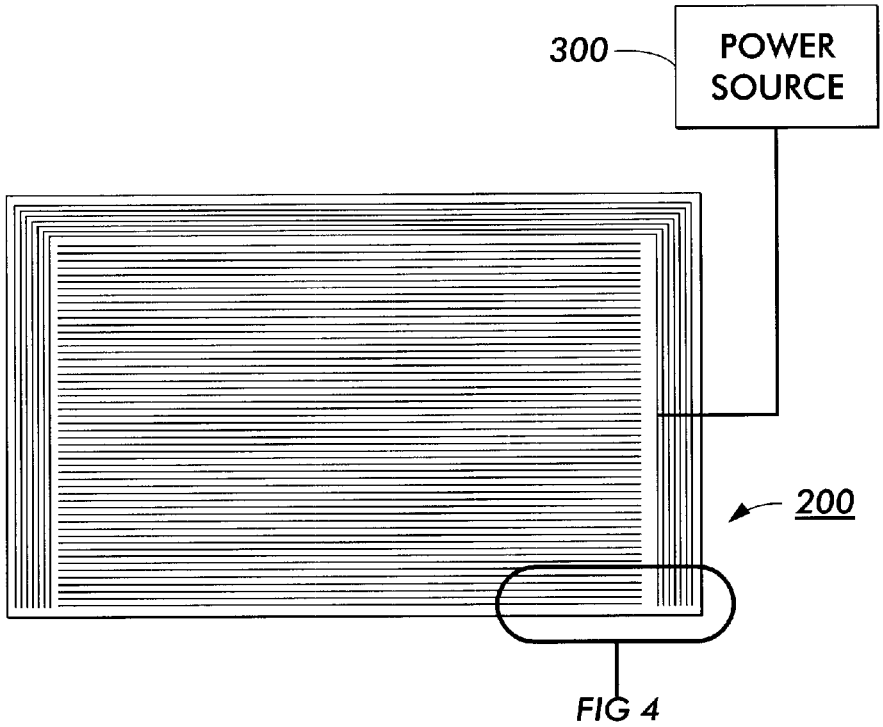
FIGS. 3 and 4 are top views of a portion of the flexible transport grid of the present invention.
Figure 4:
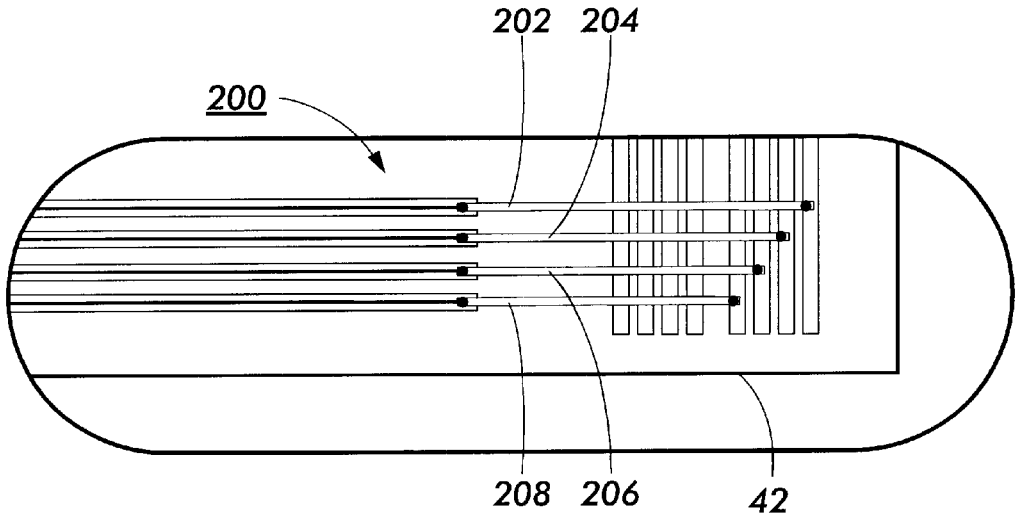

Cleaning blade 130 has a flexible circuit board 210 on a surface of the cleaning blade 130. Flexible circuit board 210 has a finely spaced electrode array 200 thereon as shown in FIGS. 3 and 4. The typical spacing between electrodes is between 75 and 100 microns. The electrode array 200 has a four phase grid structure consisting of electrodes 202, 204, 206, and 208 having a power source and a wave generator 300 operatively connected thereto in the manner shown in order to supply the proper waveform in the appropriate electrode. The traveling wave is generated by alternating voltages of three or more phases applied to the linear array of electrodes placed about the outer periphery of the conveyor. A force F for moving the toner about the conveyor is equal to QEt where Q is the charge on the toner and Et is the tangential field supplied by a multi-phase AC voltage applied to the array of electrodes.

Applicants have found that toner cleaned by the tip of a cleaning blade often piles up on top of the blade and the supporting blade holder. This is often not a problem if the architectural location of the cleaner allows gravity to pull the toner pile down the blade surface. However, in many other architectural locations gravity does not assist toner flow and toner transport becomes a problem. The present invention utilizes an electrode array or transport grid in which toner is transported by travelling electric fields from the blade tip to the end of the grid. Where a transport auger 500 at the termination of the transport grid 200. A waste container (not shown) is located behind the blade to collect the waste.

The grid could extend much further to a remote waste container. The grid could also extend back to the developer housing to enable toner reclaim. The blade cleaner shown in FIG. 2 could be positioned at other architectural locations (the photoreceptor belt and blade tipped to the left or right) and still provide good toner transport. Also shown in FIG. 2 is a second transport grid 220 mounted to the right hand side of the entrance hopper into the transport auger. This second transport grid aids toner flow into the auger and prevents toner bridging across the opening to the auger.

For some architectural locations of the cleaner (see FIG. 5.) the second transport grid may need to be extended across the housing wall opposite to the cleaning blade and the transport grid on the blade could be eliminated.

Figure 5:
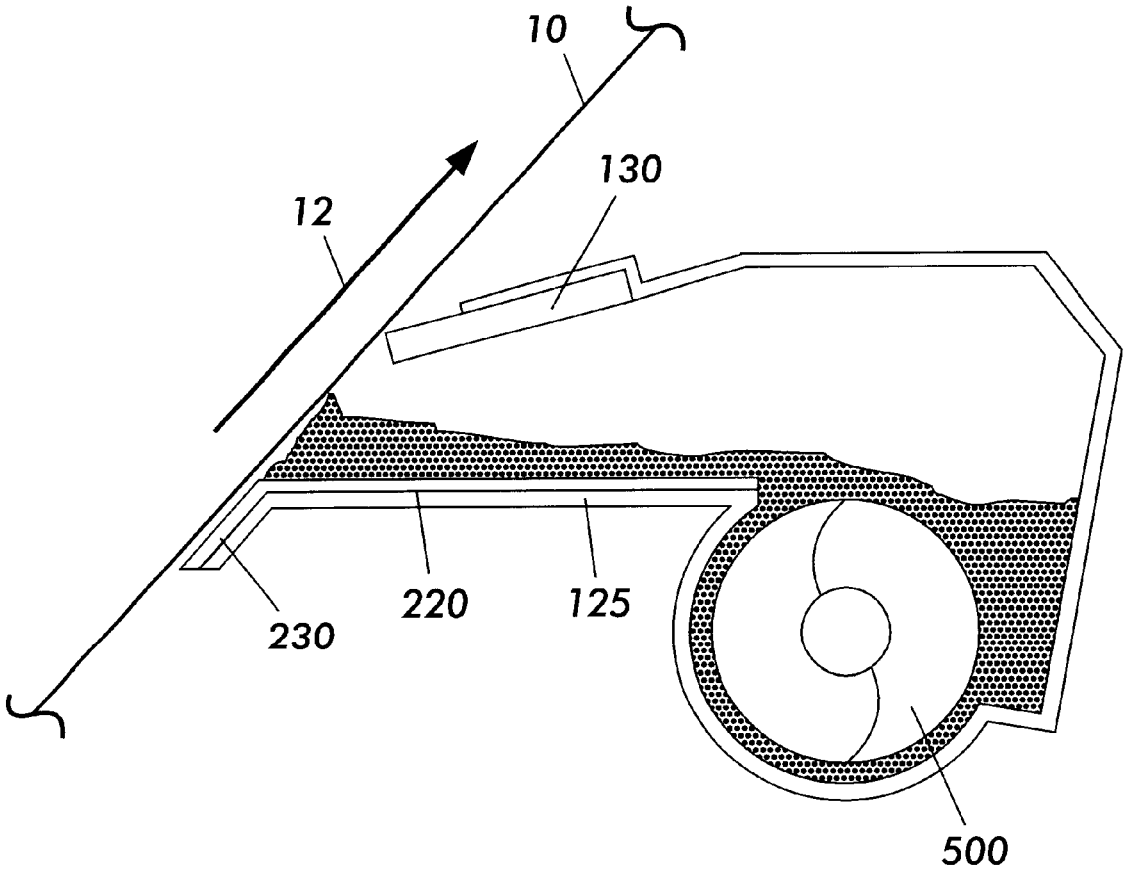

All of these configurations result in reliable toner flow away from the cleaning blade tip and minimize cleaner subsystem volume. An additional advantage can be gained if the transport grid is extended along the housing at the toner inlet 230 to the cleaner as shown in FIG. 5. The transport grid can now decrease the amount of toner emissions from the cleaner by capturing and transporting toner clouds and toner droppings back into the cleaner housing. Because of the close spacing of the transport grid to the photoreceptor belt at the toner inlet 230, toner trying to escape from the housing is more likely to contact the traveling wave grid and be transported back into the cleaner housing.

It is, therefore, apparent that there has been provided in accordance with the present invention, a cleaning system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for removing residual toner particles from an imaging surface, comprising:

a cleaning blade having an edge adapted to remove the residual toner particles from the imaging surface;

an electrode array, coacting with said cleaning blade, for removing said residual toner particles in a direction of movement away from the edge of said cleaning blade, said cleaning blade has said electrode array on a surface thereof, and a wave generator for generating a traveling wave pattern for moving said residual toner particles in said direction of movement.

2. The apparatus of claim 1, wherein a second electrode array is disposed from said cleaning blade.

* * * * *